United States Patent [19]

Klein

[11] Patent Number: 4,923,382

[45] Date of Patent: May 8, 1990

[54] PRESS FOR PRODUCING PRECISION PARTS FROM POWDERED MATERIAL

[75] Inventor: Theodor Klein, Burbach, Fed. Rep. of Germany

[73] Assignee: Theodor Grabener Pressensysteme GmbH & Co. KG, Netphen, Fed. Rep. of Germany

[21] Appl. No.: 272,733

[22] Filed: Nov. 17, 1988

[30] Foreign Application Priority Data

Nov. 19, 1987 [EP] European Pat. Off. ..... 87117037.9

[51] Int. Cl.[5] ..... B30B 11/02

[52] U.S. Cl. ..... 425/78; 425/193; 425/354; 425/355; 425/411; 425/451.5; 425/592

[58] Field of Search ..... 425/188, 193, 218, 406, 425/411, 78, 451.5, 451.6, 451, 409, 592, 593, 354, 355

[56] References Cited

U.S. PATENT DOCUMENTS

| | | | |
|---|---|---|---|
| 2,867,844 | 1/1959 | Hall | 425/193 |
| 3,545,045 | 12/1970 | Vinson | 425/78 |
| 3,687,586 | 8/1972 | Hasa et al. | 425/78 |
| 3,752,622 | 8/1973 | Viadana | 425/78 |
| 3,773,446 | 11/1973 | Borrini | 425/78 |
| 3,826,599 | 7/1974 | DeSantis et al. | 425/78 |
| 4,166,716 | 9/1979 | DeSantis et al. | 425/352 |

FOREIGN PATENT DOCUMENTS

| | | |
|---|---|---|
| 289638 | 11/1988 | European Pat. Off. . |
| 305566 | 3/1989 | European Pat. Off. . |
| 120177 | 3/1899 | Fed. Rep. of Germany . |
| 1627942 | 11/1969 | Fed. Rep. of Germany . |
| 2424802 | 12/1975 | Fed. Rep. of Germany . |
| 1141114 | 1/1969 | United Kingdom . |

*Primary Examiner*—Jay H. Woo
*Assistant Examiner*—K. P. Nguyen
*Attorney, Agent, or Firm*—Fitch, Even, Tabin & Flannery

[57] ABSTRACT

A press, especially for the manufacture of die-formed parts of dimensional accuracy made of powdered materials is described, which can be equipped and used interchangeably either for the use of the so-called smoothing process or the so-called plunger process. It includes a press support 103 on which a fixed press bed 104 and a vertically slidable press frame 105 are mountred for movement relative to each other by a mechanical drive, preferably a toggle linkage 106, to form a main press ram. Further, it has a bottom ram passing upwardly through the press bed 104 which serves as a smoothing ram or a plunger ram, being operated for both purposes by a double-arm lever 123 pivoted on the press support and actuated by a rock lever 133 likewise pivoted on the press support 103 and having a sliding pivoting connection to the double-arm lever 123. The rock lever 133 can be driven selectively from one or the other of two cam-follower arms pivoted on the press support 103 coaxially with the rock lever 133 and each separately engaged with one of two radial cams.

14 Claims, 4 Drawing Sheets

PRESS FOR PRODUCING PRECISION PARTS FROM POWDERED MATERIAL

This invention relates to a press for the manufacture of dimensionally accurate die-formed parts from powdered materials, but which is also applicable to other processes, such as synthetics pressing, deep-drawing and stamping.

BACKGROUND OF THE INVENTION

The press to which the invention is applied is a press having a press support, which guides a movable press frame, and supports a press bed. These are interconnected by means of a mechanical drive, preferably a toggle lever drive, to form a main press ram. Such a press may further be provided with an auxiliary bottom ram capable of serving as a smoothing ram or a plunger ram for the press bed and which can be operated by means of a lever pivotally mounted within the press support and driven by a mechanical drive, such as a cam drive.

Presses of this general type have already been developed and are described in the European Patent Application Nos. 87/106634.6 and 87/112788.2, for example.

Presses developed along these lines not only assure consistently reproducible operation of all interacting press axes, but may at the same time be operated at a relatively high stroke rate. Furthermore, a high degree of inherent stability of the entire press system at a consistently high degree of operational safety is obtained.

It is of particular advantage that such a press system, while using an already existing toggle press, can be enhanced by integrating additional hydraulic press elements. In this manner, possibilities for flexible movement and drive are obtained for the individual press axes, as well as pressure-independent path control of the same.

According to the European Patent Application No. 87/106634.6, the mechanical press element of the press, i.e., the press bed, is already provided with an additional bottom ram which can be operated by means of a mechanical drive of the cam type. This bottom ram forms the so-called G-press axis, which makes it possible to operate the press in accordance with the so-called plunger process or in accordance with the so-called smoothing process, wherein the bottom ram either forms the press plunger or the press smoothing ram.

SUMMARY OF THE INVENTION

It is the goal of the present invention to optimize the operation of the bottom ram of a press of the initially specified type by means of a structurally simple arrangement through which the drive of the auxiliary bottom, or "G-axis", ram is adapted to serve either the smoothing or the plunger function, respectively, as may be required. This is accomplished with a drive system of components which adapt existing mechanical presses, by retrofitting, to operate the bottom ram either in the smoothing process only or in the plunger process only, but which allow selective or alternating operation of both processes in a single press.

The selective drive arrangement of the invention for the described purpose includes a double-arm lever, one arm of which engages the bottom ram, while its other arm is connected in an articulated manner with an intermediate lever, which in turn is located on a rocker shaft accommodated within the press support, and the provision of means to couple the rocker shaft with a single mechanical drive, through one or the other of two different drive trains.

According to the invention, the advantage of this arrangement lies in that, in the simplest case, merely the specifically needed drive train is installed in the press between the mechanical drive and the bottom ram and in such a manner, that the press either receives only that drive train needed for the operation of the bottom ram during the smoothing process or only that drive train provided for the operation of the bottom ram during the plunger process. However, it is preferable to simultaneously equip the press at all times with both drive trains, so that it is ready for the smoothing process or the plunger process, as desired. In the latter case, the rocker shaft can be coupled selectively and alternatively with two different drive trains of the mechanical drive.

According to an additional characteristic of the invention, the two drive trains each consist of at least one lever which can be engaged and disengaged from the rocker shaft, as well as of at least one radial cam to actuate the latter, wherein all radial cams are located on a common drive shaft, preferably also carrying the crank for the toggle linkage, which drives the main press ram.

Another important aspect of the invention lies in the adjustability of the effective reach of the intermediate lever and of the arm of the double-arm lever, coupled thereto in a link joint connection, so that the stroke path for the bottom ram can be altered at any time in a simple manner. By this means, the transmission ratio of the intermediate lever to the double-arm lever can be altered in a continuous manner in a range of from 0 to 1:2.5.

For this purpose, the invention proposes that the pin which connects the intermediate lever with the double-arm lever be mounted in blocks slidable in both, and in this way can be positioned by a spindle actuator located on or in the second arm of the double-arm lever. By means of these steps, remotely controlled alteration of the transmission ratio is made possible.

According to another aspect of the invention, it is proposed that the lever of one drive train be constructed in the form of a bell crank, one arm of which follows a radial drive cam on the drive shaft, while its other arm extends into the effective range of a radial blocking cam, also carried on the drive shaft. In this manner, positive guide control of this drive train by the drive shaft is assured, i.e., for that sector of the cam cycle which corresponds to the press position of the upper die in the lower dead center position of the main or X-axis of the press. The press matrix, which during the press path is moved in a downward direction with respect to the X-axis, for example through a hydraulic means, receives thereby a fixed stopping point via the double-arm lever.

On the other hand, the lever of the second drive train is a single-arm lever which extends into the effective range of a second radial drive cam and maintains constant contact with the latter by means of a pressure medium cylinder, such as a hydraulic cylinder.

Another important aspect of the invention lies in the provision of independent means to move the double-arm lever and the intermediate lever to an inactive position, at which the clutch devices between the rocker shaft and the levers of the two drive trains mounted thereon, cannot be engaged.

Further according to the invention, it has also been proven to be of advantage when the clutch arrangement consists of clutch arms which are rigidly secured on the rocker shaft, slide pins which are adjustably arranged on the cam follower levers transversely to their plane of motion, wherein these slide pins can be engaged with and disengaged from receiving sockets on the clutch arms, by means of pressure cylinders, such as hydraulic cylinders. According to the invention, these slide pins of the clutch arrangement may be in the form of overload safeguards, i.e., provided with predetermined breaking strengths.

Within the framework of the invention, it is furthermore proposed that the shorter arm of the double-arm lever movably engage a pressure block arranged with restricted movement within the bottom ram, parallel to the latter's direction of displacement, with adjustment buffers between the pressure element and the bottom ram, through which the extent of relative movement can be altered.

The pressure block is preferably provided with an adjustable buffer at each end, adjustable selectively and remotely by means of a proper drive, such as an electromechanical drive.

It has also been proven to be of advantage when, in accordance with the invention, the bottom ram comprises a carriage, which is arranged within the press bed console in a vertically adjustable manner, and wherein the carriage is provided with clutch elements which permit its engagement and disengagement from the ram proper by relative movement transverse to the axis of the ram.

The press of the invention makes it possible for the bottom ram to perform a number of functions.

During operation of the so-called smoothing process in conjunction with the hydraulic press element, the smoothing movement in a downward direction can be achieved with a force of Pmax=2000 kN, for example. For this purpose, a smoothing stroke has to be established which can be varied between 0 and 80 mm, for example. Necessary corrections of the height of the bottom ram can be carried out by means of an electromechanical adjustment of the buffers therein. The mechanical setting of the bottom ram in the press position can also be achieved by means of the radial blocking cam. Moreover, an electromechanical adjustment of the bottom ram in its press position, on the one hand, and in its loading (charging) position, on the other hand, is possible.

For the plunger process, the plunger movement in upward direction can be achieved with a force of Pmax=2000 kN, for example, and subsequently the discharge movement can take place. Also, in this case, the stroke path of the bottom ram can be continuously adjusted across a range of 0 to 80 mm, for example, and an electromechanical adjustment of the buffers for the press position as well as for the loading position can be effected.

If both gear trains are present in the press, then the transition of the press from the smoothing process to the plunger process and vice-versa can be readily achieved.

For both the smoothing process and the plunger process, the slide pins of the clutch arrangements may be in the form of overload safeguards, which prevent damage to other functional components of the press.

With respect to the plunger process, it may also be advantageous if the radial cam of the respective gear train is mounted on the drive shaft in a manner permitting easy exchange, so that the stroke motion of the bottom ram can be adjusted without difficulty to meet varying needs.

All remaining functions of the press during the smoothing process, such as the lowering of the pressing die matrix, the electromechanical adjustment of the initial lowering process, the upwardly directed positioning of the bottom ram and the height adjustment of the upper connection piece were preferably brought about via the hydraulic press element of the press system.

All functions of the press can either be carried out individually from an operating console, i.e., by pressing a button, or they can also be automatically entered and controlled through a computer program via a tool code.

DESCRIPTION OF THE DRAWINGS

The objective of the invention is demonstrated in one example in the drawings, wherein.

DETAILED DESCRIPTION OF THE PREFERRED EMBODIMENT

Figure 1:
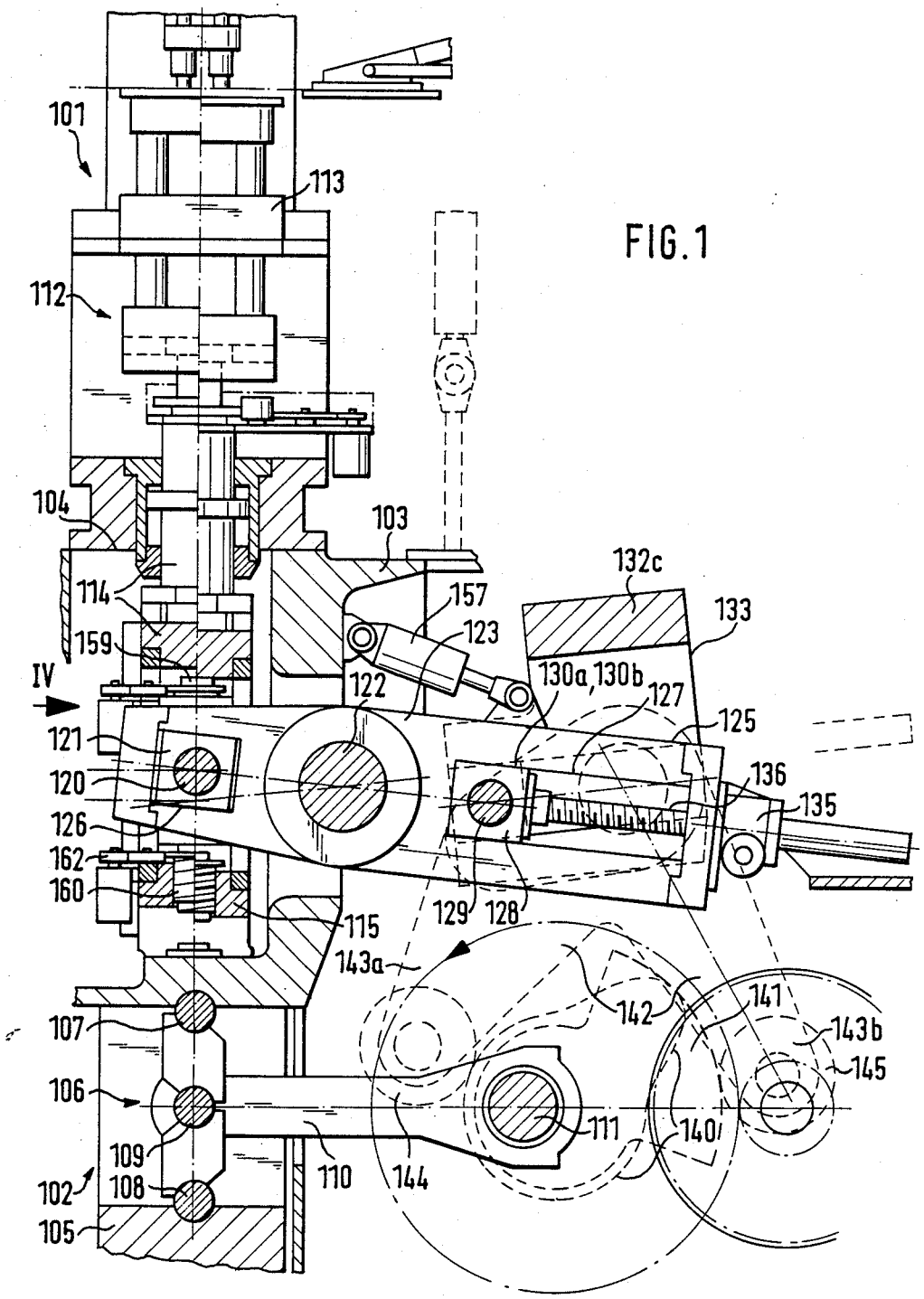
FIG. 1 shows a side view in vertical cross section along line I—I in FIG. 3 of the area of the press element, essential to the invention, of a press system which is assembled for hydromechanical operation, for example.

The drawing shows essentially only the mechanical press element of a hydromechanical press system 101, which is provided with a toggle drive 102. The mechanical press element has a press support 103, carrying a press bed 104 on which a press frame 105 is mounted in such a way that it can be raised and lowered relative to press bed 104.

Press frame 105 is moved relative to the press support 103 by the toggle 106, which on the one hand, engages the press support 103 via a fixed joint 107, and on the other hand, engages press frame 105 via a movable joint 108. A push rod 110 is pivotally connected at one end with the knee joint 109 of the toggle, and journalled at its other end to the crank pin of a crank drive 111 accommodated within the press support 103.

The push rod 110 at its connection to the crank drive 111 is moved in a circular path while its end connected to the knee of the toggle system 106 continuously undergoes alternating motions between its extended position (FIG. 1) and a predetermined bent position of the toggle. In this manner, press frame 105 traverses, relative to press bed 104, a predetermined and relatively long stroke path.

Figure 4:
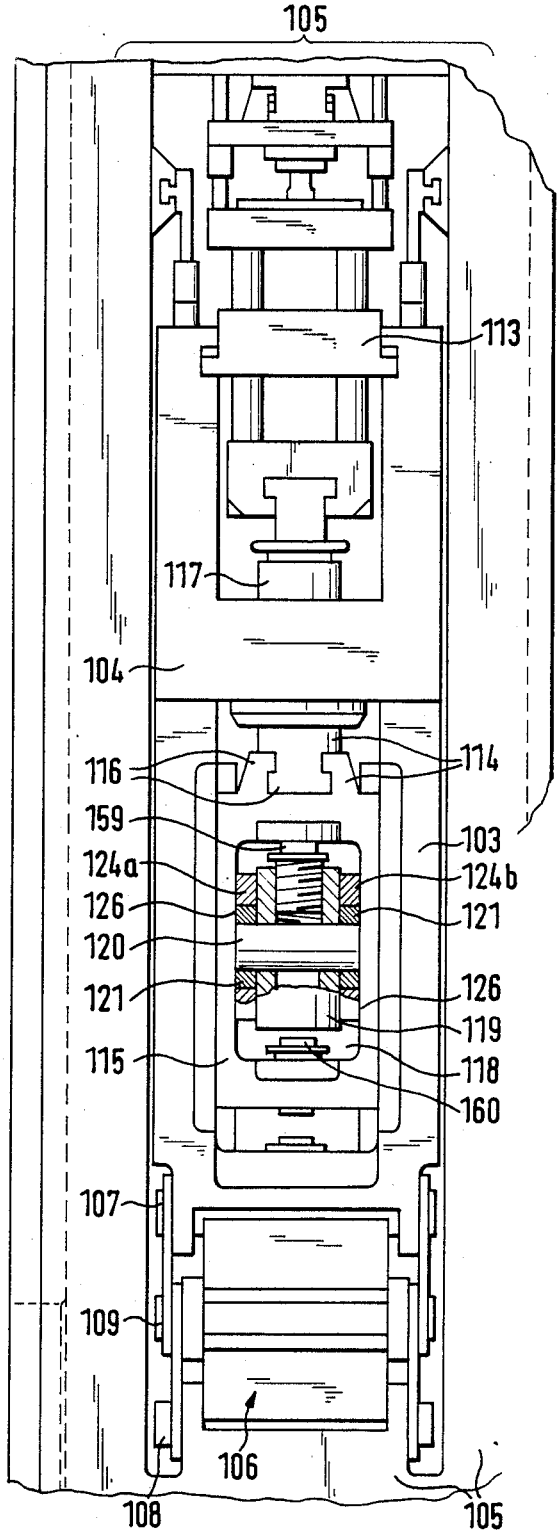
FIG. 4 shows a front view of the press in the direction of arrow IV of FIG. 1.

Within the mechanical press element, i.e., the toggle drive of the press frame 105, rising and falling relative to the stationary press bed 104, a hydraulic press element 112 is accommodated, which is only partially indicated in FIGS. 1 and 4. Also, the actual pressing die 113 is only indicated in FIGS. 1 and 4.

The main press ram of the overall hydromechanical press system 101 is formed by the interaction of press bed 104 and press frame 105 of the toggle press 102, as the so-called main or guide axis, also called the X-axis, and serves for the entire hydromechanical press system 101.

Other additional press axes of the hydromechanical press system 101, such as the so-called M-press axis, the so-called Z-press axis, and the so-called Y-press axis (which is irrelevant to the presently described situation), can be formed by the hydraulic press element 112.

It is, however, essential to the mechanical assembly of the hydromechanical press system 101 that, in addition to the toggle press 102 which forms the so-called main or guide axis, i.e., the so-called X-axis, an additional mechanical press axis, the so-called G-press axis, is provided. The drive for this G-press axis is also derived from the crank drive 111 for the toggle press 102.

The G-press axis operates with a bottom ram 114, which can only be seen in FIGS. 1 and 4 of the drawing. It includes a carriage 115, vertically slidable on ways within the press bed console 103 as an intermediate piece with limited vertical movement, and an extension piece 117 connected thereto for vertical movement of the extension piece upwardly through press bed 104, so that it can interact with the pressing die 113 or the like. The connection 116 of the carriage 115 and extension piece 117 is made and can be broken by relative movement of the two parts transversely of the ram axis.

The carriage 115 of the bottom ram 114 has, according to FIG. 4 of the drawing, an open, frame-like structure. Within the frame opening a pressure block 119 is positioned, which carries a transverse bearing pin 120, the ends of which are received in slide blocks 121 flanking the pressure block 119.

Within the press support 103, about a horizontal transverse axis 122, a double-arm lever 123 is mounted on the vertical plane with restricted pivotal movement, the shorter arm 124 of which is fork-like, its fork elements 124*a* and 124*b*, extending past the pressure piece 119 into the frame opening 118 of the carriage 115, as can be seen in FIG. 4. Both fork-like elements 124*a* and 124*b* of the shorter arm 124 have a slide groove 126, in which one of the two slide blocks 121 is accommodated in a manner allowing limited longitudinal displacement, inasmuch as the slide blocks journal the bearing pin 120.

The longer arm 125 of the double-arm lever 123 is also provided with a slide groove 127, which extends along the greatest portion of its length and serves as a track for a slide block 128. In this slide block 128, a joint pin 129 is arranged in such a way that it protrudes in opposite directions beyond the slide block 128. Onto each end of the joint pin 129, a guide element 130*a* or 130*b* (FIG. 3) is slipped in a link joint manner, and is accommodated in one of the grooves 131*a* or 131*b* in a slidable way. Each of these slide grooves 131*a* and 131*b* is located on the inside of two side walls 132*a* and 132*b* of an intermediate lever 133. Both side walls 132*a* and 132*b* of the intermediate lever 133 have an angular shape and are connected near the end of one of their sides to a bracket by means of a crossbar 132*c* in a single piece arrangement. The slide grooves 131*a* and 131*b* extend parallel to the longitudinal direction of the other sides of both side walls 132*a* and 132*b*.

On the outside of each side wall 132*a* and 132*b* of the intermediate lever 133, rocker shafts 134*a* and 134*b* are attached rigidly and in a single piece in such a way that the longitudinal central axes of the same not only align with each other, but also pass through the intersecting point of both longitudinal central planes of the sides of both walls 132*a* and 132*b*. The longitudinal central plane of the slide grooves 131*a* and 131*b* intersects with the longitudinal axes of both rocker shafts 134*a* and 134*b* as well.

Through the slide block 128, the joint pin 129 and the guide elements 130*a* and 130*b*, the intermediate lever 133 via its slide grooves 131*a* and 131*b*, as well as the double-arm lever 123 via the slide groove 127, located in its longer arm 125, are movably linked in a drive connection in such a way that each pivoting movement of the intermediate lever 133 is necessarily transferred to the double-arm lever 123.

The transmission ratio of the transfer of movement from the intermediate lever 133 to the double-arm lever 123 can be varied, preferably across a range which includes the value 0 and reaches a transmission ratio of up to 1:2.5. For the continuous setting and altering of this transmission ratio, a spindle actuator 135 is provided, which is built into the longer arm 125 of the double-arm lever 123, with its spindle 136 engaging slide block 128. By operating the spindle actuator 135, the slide blocks 128 and 130*a*, 130*b*, which are connected with each other by means of the joint pin 129, can be slid jointly along the slide grooves 127, and 131*a*, 131*b*, so that, depending on the respective slide position, the transmission ratio changes. If the setting is carried out in such a way that the longitudinal axis of the joint pin 129 coincides with the longitudinal axis of the rocker shafts 134*a* and 134*b*, the intermediate lever 133 with its rocker shafts 134*a* and 134*b*, can pivot without causing any pivotal movement of the double-arm lever 123. In this case, the transmission ratio is 0.

Figure 3:
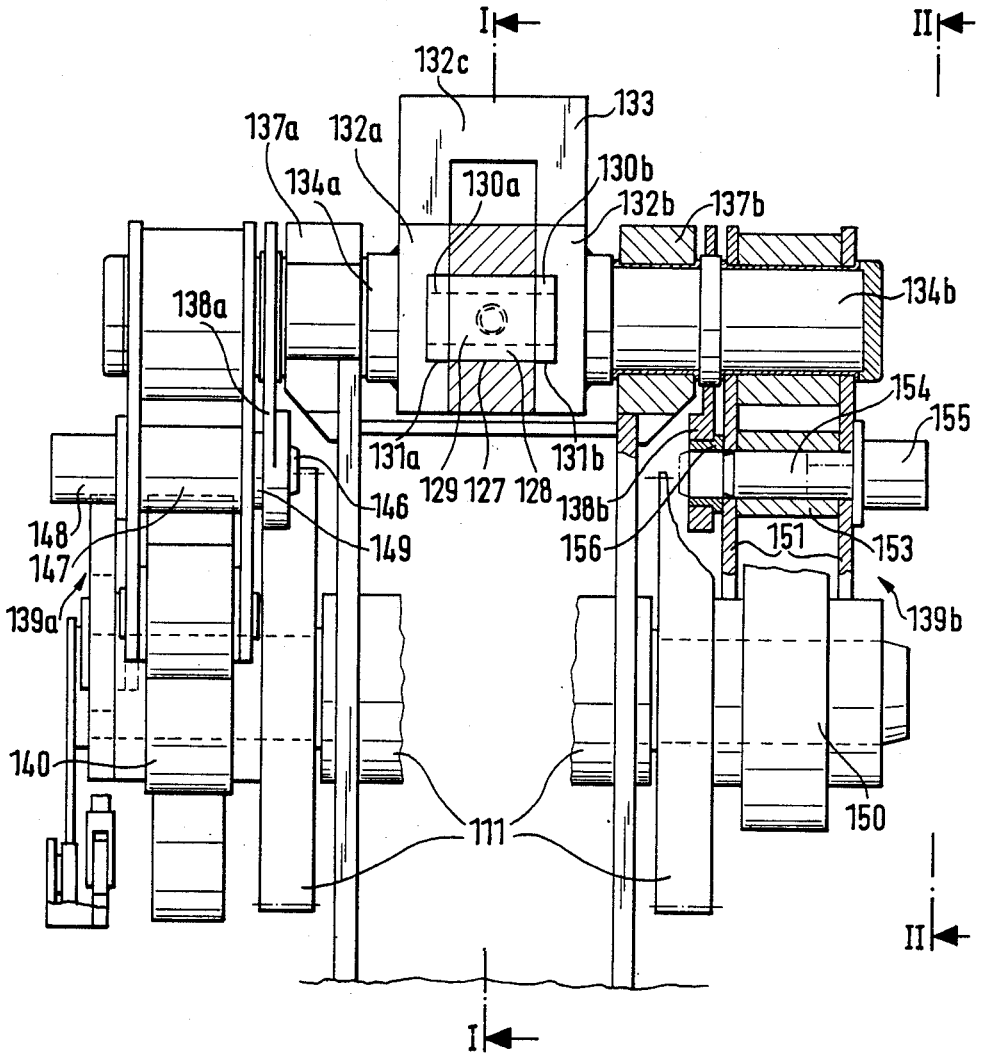
FIG. 3 shows a partial front view and a partial cross section along line III—III in FIG. 2.

From FIG. 3 of the drawing it can -be seen that the intermediate lever 133 is held, via its two rocker shafts 134*a* and 134*b* in stationary bearings 137*a* and 137*b* of the press support 103. The rocker shafts 134*a* and 134*b* protrude from both bearings 137*a* and 137*b* to a considerable degree. Through the direct connection to the bearings 137*a* and 137*b*, arms 138*a* and 138*b* are rigidly secured to the rocker shafts 134*a* and 134*b*, to serve as clutches in a manner yet to be described.

The drive of the intermediate lever 133 by means of rocker shafts 134*a* and 134*b* can take place by means of two different drive trains 139*a* and 139*b*, which share the main drive with the crank 111 for the toggle drive 106.

Figure 2:
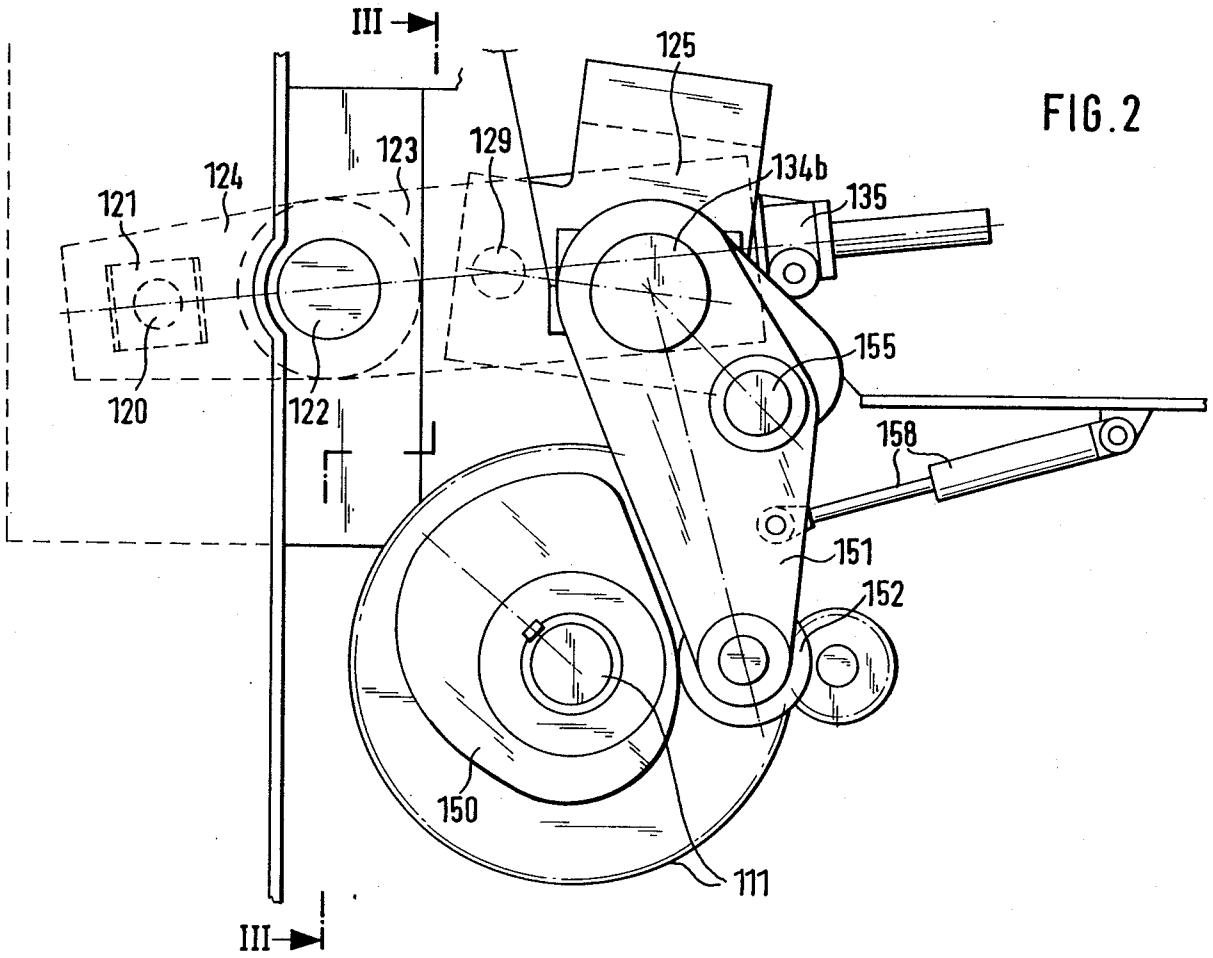
FIG. 2 shows the area of the mechanical press element in accordance with FIG. 1 essential to the invention as viewed in the direction of arrow II—II of FIG. 3.

The drive train 139*a* shown in FIG. 3 on the left, can also be seen in broken lines FIG. 1 of the drawing, while the drive train 139*a* shown on the right in FIG. 3 is also shown in FIG. 2.

The drive train 139*a* comprises a radial drive cam 140, rigidly pressed and keyed on the drive shaft of the crank drive, and a radial blocking cam 141, also rigidly mounted on this shaft, as well as a bell crank 142, which is journalled on the left end section of the left rocker shaft 134*a* of the intermediate lever 133, as can be seen from FIG. 3. The bell crank carries, at the free end of its arm 143*a*, a roller 144 and at the free end of its arm 143*b*, a roller 145. While roller 144 interacts with the curve contour of the radial drive cam 140, roller 145 is assigned to the peripheral contour of the radial blocking cam 141.

From FIG. 1, it can be seen that beyond a certain angle of rotation of the drive shaft, roller 144 of the arm 143*a* on the one hand, and roller 145 of the arm 143*b*, on the other hand, simultaneously rest against the peripheral contour of the radial drive cam 140 and the radial blocking cam 141, so that the bell crank 142 remains stationary. However, as soon as and as long as roller 145 of the arm 143*b* is disengaged from the radial blocking cam 141, a swing of the bell crank 142 about the longitudinal axis of the rocker shaft 134*a* is effected by roller 144 and the arm 143*a*.

As long as the bell crank 142 is not drivingly connected with the rocker shaft 134*a*, it cannot transfer its movement to the intermediate lever 133. In this case, it must engage the arm 138*a* serving as a clutch on the rocker shaft 134*a*. For this purpose, a slide pin 146, located in a guide housing 147 on the bell crank 142, is used as a coupling device, and can be moved with the aid of a pressurized cylinder 148. In its retracted position, the slide pin 146 does not engage the clutch bushing of the arm 138*a*, and the bell crank 142 can pivot idly about the rocker shaft 134*a*. If, however, the slide pin 146 is extended into the clutch bushing of arm 138*a*, its pivoting movement is transferred onto the rocker shaft 134*a* via the arm 138*a*. The movement which has been transferred from the bell crank 142 onto the rocker shaft 134*a* is transferred to the intermediate lever 133 and thus to the double-arm lever 123 as well.

The drive train 139*b*, shown on the right side of FIG. 3, has a radial drive cam 150 which is rigidly connected with the drive shaft for the crank drive 111 and which interacts with a lever 151 via a roller follower 152, as can be clearly seen in FIG. 2. Thus, the lever 151 is journalled on the right end of the right rocker shaft 134*b*, as can be clearly seen in FIG. 3. Also in this case, the lever 151 is disengaged from the rocker shaft 134*b* as long as the slide pin 154, which is guided within a guide housing 153 of the lever 151 in the form of a coupling device, is in its disengaged position, which can be seen in FIG. 3. If, however, this slide pin 154 is slid axially into the clutch bushing 156 of the arm 138*b*, which is rigidly secured to the rocker shaft 134*b*, by means of the cylinder 155, as indicated by dotted lines, then the movement of the lever 151 can be transferred to the rocker shaft 134*b*, and via the latter to the intermediate lever 133.

Naturally, steps have been taken to prevent simultaneous movement of both slide pins 146 and 154 into their engaged position through their respective cylinders 148 and 155. These steps may include that each of the two cylinders 148 and 155 can be activated only when at the point of their operation both slide pins 146 and 154 are in their disengaged position. If, however, one of the two slide pins 146 and 155 is engaged, the other is interlocked through the control system to remain disengaged.

In order to assure that during the resting phase of the press orderly engagement and disengagement of the slide pins 146 or 155 can take place, a hydraulic cylinder 157, resting on the press support 103, engages the double-arm lever 123. This cylinder actuates the double-arm lever 123 in such a way that the clutch bushings of the clutch levers 138*a* and 138*b* are moved into and out of the restricted range of movement of the slide pins 146 and 155 of the bell crank 142 and the lever 151 to allow engagement of the slide pins 146 and 155 to take place only when intended.

In order to maintain the one-armed lever 151, via its roller 152, in constant driving engagement with the peripheral contour of the respective radial cam drive 150, a hydraulic cylinder 158 rests on the press support 103, its piston rod engaging lever 151 and holding same in the direction facing the radial cam drive 150 in a pretensioned manner.

At this point, it should be mentioned that the drive arrangement for the bottom ram 114 of the mechanical press element does not necessarily have to be equipped with the two drive trains 139*a* and 139*a* for the intermediate lever 133. Rather, it is easily possible to either provide only the drive trains 139*a* or the gear train 139*b* only. The respectively absent gear trains can, however, be retrofitted into the press at any time, should this become necessary. It is also easily possible to remove the drive trains already contained in the press and to replace them with another drive train.

A hydromechanical press system 101 which is to be operated in accordance with the so-called smoothing process, as well as in accordance with the so-called plunger process should, however, be equipped from the beginning with preferably both drive trains 139*a* and 139*b* for the intermediate lever 133.

In each case, the drive train 139*a* is provided for the operation of the hydromechanical press system 101 in accordance with the so-called smoothing process, while the gear train 139*b* makes operation of this hydromechanical press system 101 possible in accordance with the plunger process.

Since in this plunger process, the pressing force as well as the discharge force on the bottom ram 114 act via the intermediate lever system and roller 152 against the radial drive cam 150, an additional radial blocking cam is not required in this case.

The pressure block 119 in the frame opening 118 of the carriage 115 is provided with an upper adjustable stop 159 and a lower adjustable stop 160. The upper stop 159 is adjusted by an electromechanical drive 161, while the lower stop 160 is adjusted by a corresponding electromechanical drive 162.

While, with the aid of the upper adjustable stop 159, exact adjustment of the press path during the smoothing process is assured, exact adjustment of the filling height within the press die 113, for the smoothing as well as for the plunger process, can be achieved with the aid of the lower adjustment stop 160.

What is claimed is:

1. In a press for the manufacture of die-formed parts from powdered material, comprising a press support having thereon a ram in the form of a press frame movable in ways on the press support in opposition to a press bed fixed on said support, and driven by a mechanical drive to constitute the main ram of the press, and a secondary ram movable through the press bed in cooperative opposition to the main ram by a mechanical drive terminating in a lever pivoted on the press support and pivotally connected to the secondary ram, wherein the improvement comprises an arrangement in which the lever which drives the secondary ram is a double-arm lever, one arm of which engages the secondary ram and wherein the mechanical drive of which the lever is a part includes a rock arm which is pivoted on the press support and is slidably and pivotally connected to the other arm of said lever, and wherein the rock arm is selectively interchangeably and detachably connectable to a single drive shaft through one or the other of two drive trains.

2. A press according to claim 1 wherein the rock arm is pivoted to the press support by means of an integral rocker shaft journalled in bearings in the press support, both drive trains include a follower lever which can be coupled to and uncoupled from the rocker shaft, and a radial cam on said drive shaft engaged with said follower lever, and wherein said single drive shaft is driven from the mechanical drive of the main press ram.

3. A press according to claim 1 wherein the effective length or the rock arm relative to the length of the other arm of the double-arm lever is adjustable by relocating the pivotal interconnection of said two arms along the length of one of them.

4. A press according to claim 3 wherein the pivotal interconnection of said two arms is provided by a pin carried by a slide block housed in a slot in the double-arm lever, said pin also being slidable along the rock arm to a limiting position in alignment with the rocking axis, the position of the slide block in said slot being adjustable to vary the transmission ratio from the rock arm to the double arm lever from zero to 1:2.5.

5. A press according to claim 4 wherein the adjustment of the slide block within its slot in the double-arm lever is made and maintained by a motor-driven screw.

6. A press according to claim 2 wherein the cam follower lever of one of said drive trains is a bell crank lever having the other of its arms disposed for engagement with a radial blocking cam on said drive shaft.

7. A press according to claim 6 wherein the blocking cam and its associated bell crank arm are engaged during that sector of the cam cycle which corresponds to the lower dead center position of the main or X-axis of the press.

8. A press according to claim 6 wherein the follower lever of the other of said drive trains is maintained in engagement with its respective drive cam by a pressurized cylinder.

9. A press according to claim 2 wherein the coupling of the cam follower levers to the rocker shaft of said rock arm can be effected only when said levers and shaft occupy a given relative rotative position within a limited range of rotation of said rock shaft, and separate drive disabling means for rotating said rock shaft out of said limited range.

10. A press according to claim 2 wherein the means for coupling and uncoupling the cam follower levers from the rocker shaft includes, in each case, a clutch arm secured to the rocker shaft alongside said follower lever, and a cross pin slidably mounted on one of said clutch arm and cam follower lever and receivable in a socket in the other to secure the follower lever to the rocker shaft.

11. A press according to claim 10 wherein the cross pins are urged into and out of coupling engagement by a pressure cylinder under remote control and wherein said cross pins also serve as overload shear pins.

12. A press according to claim 1 wherein said one arm of the double arm lever engages the secondary ram in a pivotal connection to a pressure block which is relatively movable within the ram structure in the direction of ram movement, said pivotal connection to said one arm of the double-arm lever being slidable axially of said one arm, and adjustable buffers between the pressure block and the ram structure at each end of said relative movement of the pressure block to vary the extent of said relative movement.

13. A press according to claim 12 wherein the adjustment of each buffer is accomplished selectively by a remotely controlled electromechanical drive.

14. A press according to claim 12 wherein the ram structure of the secondary ram comprises an upper plunger which passes upwardly through the press bed and a lower carriage frame within which said pressure block is relatively movable said plunger and carriage being engageable and disengageable by relative movement transverse to the direction of operational movement of the ram.

* * * * *

UNITED STATES PATENT AND TRADEMARK OFFICE

CERTIFICATE OF CORRECTION

PATENT NO. : 4,923,382

DATED : May 8, 1990

INVENTOR(S) : Theodor Klein

It is certified that error appears in the above-identified patent and that said Letters Patent is hereby corrected as shown below:

FACE OF THE PATENT:

In the References Cited, change "Hasa et al." to --Hara et al.--

Column 6, line 46, after "lines" insert --in--.
Column 6, line 47, change "139a" to --139b--.
Column 8, line 2, change "139a", second occurrence, to --139b--.

Column 8, line 5, change "gear" to --drive--.

Column 9, line 2, change "or" to --of--.

Signed and Sealed this

Sixth Day of August, 1991

*Attest:*

HARRY F. MANBECK, JR.

*Attesting Officer*

*Commissioner of Patents and Trademarks*